US010953520B2

(12) United States Patent
Macor

(10) Patent No.: US 10,953,520 B2
(45) Date of Patent: Mar. 23, 2021

(54) OPEN-END WRENCH HEAD

(71) Applicant: Richard J. Macor, Easton, PA (US)

(72) Inventor: Richard J. Macor, Easton, PA (US)

(73) Assignee: Proprietary Technologies, Inc., Easton, PA (US)

( * ) Notice: Subject to any disclaimer, the term of this patent is extended or adjusted under 35 U.S.C. 154(b) by 361 days.

(21) Appl. No.: 16/350,552

(22) Filed: Nov. 30, 2018

(65) Prior Publication Data

US 2020/0171627 A1 Jun. 4, 2020

(51) Int. Cl.
*B25B 13/08* (2006.01)

(52) U.S. Cl.
CPC ..... *B25B 13/08* (2013.01)

(58) Field of Classification Search
CPC ..... B25B 13/02; B25B 13/04; B25B 13/06; B25B 13/08; B25B 13/463; B25B 13/48; B25B 13/481
See application file for complete search history.

(56) References Cited

U.S. PATENT DOCUMENTS 8,443,701 B1 * 5/2013 Liau ..... B25B 13/08 81/119
8,707,832 B2 * 4/2014 Liau ..... B25B 13/08 81/125.1
9,981,363 B2 * 5/2018 Liau ..... B25B 13/04

* cited by examiner

*Primary Examiner* — David B. Thomas

(57) ABSTRACT

In one example embodiment, the present invention is an open-end wrench head that has an orifice and two jaws. Each jaw has an inner part, an outer part, and a terminal tip end. Each inner part is formed for contact and engagement with a work-piece such as a nut or bolt. Each outer part is viewable from a side view of the wrench head and has a predetermined length. The outer part of at least one jaw has at least one groove formed therein creating at least two adjacent ridges running at least partially along the length thereof.

20 Claims, 4 Drawing Sheets

OPEN-END WRENCH HEAD

REFERENCES TO RELATED APPLICATIONS

This application relates to and is a continuation-in-part of U.S. patent application Ser. No. 29/651,546 filed on Aug. 29, 2018 entitled PORTION OF AN OPEN-END WRENCH JAW filed by the inventor herein.

This patent application may also relate to one or more of the following patents granted to the inventor herein: U.S. Pat. Nos. 6,267,028; 6,263,769; U.S. D437,536; U.S. Pat. No. 6,082,228; U.S. D412,819; Taiwan 129822 and Canada 94201.

FIELD OF THE INVENTION

The present invention relates to wrenches, more particularly to open-end wrenches, and most particularly to one or both jaws of an open-end wrench head.

BACKGROUND OF THE INVENTION

The jaw or jaws of an open-end wrench head are susceptible to spreading apart and bending outwardly upon the application of high torque to a work-piece such as a nut or bolt, and/or engagement failure whereby the jaws slip upon and around a work-piece. Often, the wrench head may even become damaged wherein the jaws are permanently spread apart compromising further use of the wrench. Accordingly, there is a need to strengthen the jaws of an open-end wrench to reduce the susceptibility to engagement failure and/or damage to the wrench head wherein the jaws become permanently spread apart.

SUMMARY OF THE INVENTION

In one example embodiment, the present invention is an open-end wrench head that has an orifice and two jaws. Each jaw has an inner part, an outer part, and a terminal tip end. Each inner part is formed for contact and engagement with a work-piece such as a nut or bolt. Each outer part is viewable from a side view of the wrench head and has a predetermined length. The outer part of at least one jaw has at least one groove formed therein creating at least two adjacent ridges running at least partially along the length thereof.

Accordingly, it is an objective of the present invention described herein that it can provide enhanced strength to one jaw or both jaws of an open-end wrench head;

It is another objective of the present invention that it can provide enhanced strength to one or both jaws of an open-end wrench head without adding additional material to the wrench head or cross-sectional area to the wrench jaw(s);

It is another objective of the present invention that it can provide a reduction in jaw flexibility when applying torque to a work-piece such as a nut or bolt to reduce the potential of engagement failures and "rounding" of a work-piece such as a nut or bolt;

It is another objective of the present invention that it can provide a reduction in jaw flexibility when applying torque to a work-piece such as a nut or bolt to prevent damage to the wrench head wherein the jaws become permanently spread apart;

And, it is another objective of the present invention that it is commercially viable, simple in design, and cost-efficient to manufacture.

BRIEF DESCRIPTION OF THE DRAWINGS

The present invention is more fully understood when the specification herein is taken in conjunction with the drawings appended hereto, wherein.

DETAILED DESCRIPTION OF THE DRAWINGS

The various drawings provided herein are for the purpose of illustrating examples of the present invention and not for the purpose of limiting same. Therefore, the drawings herein represent only a few of the many possible examples, embodiments, variations and/or applications of the present invention.

Figure 1:
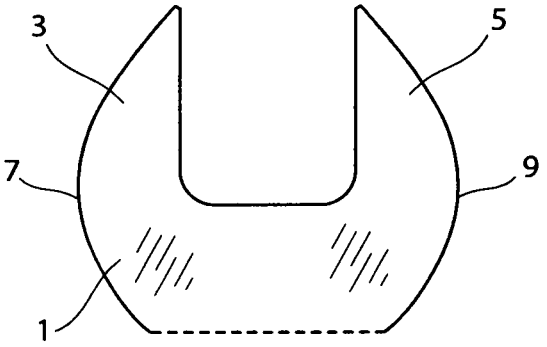
FIG. 1 prior art
FIG. 1 shows a cut, top view of a prior art open-end wrench head.
Figure 2:
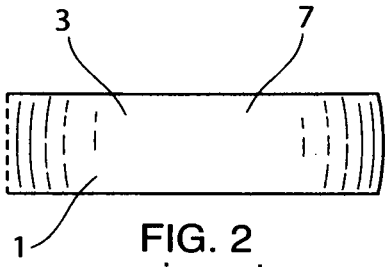
FIG. 2 prior art
FIG. 2 shows a left side elevation view of the wrench head shown in FIG. 1.
Figure 4:
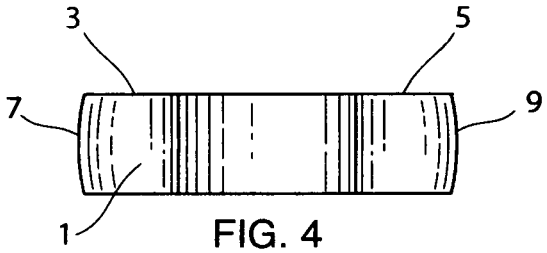
FIG. 4 prior art
FIG. 4 shows a front elevation view of the wrench head shown in FIG. 1.
Figure 3:
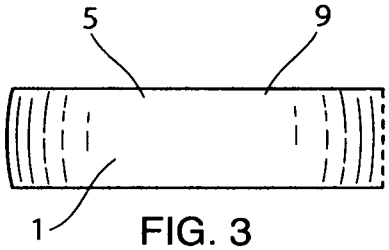
FIG. 3 prior art
FIG. 3 shows a right-side elevation view of the wrench head shown in FIG. 1.

FIG. 1 shows a cut, top view of a prior-art open-end wrench head; and, FIG. 2 shows a left side elevation view of the wrench head shown in FIG. 1; and, FIG. 3 shows a right-side elevation view of the wrench head shown in FIG. 1; and, FIG. 4 shows a front elevation view of the wrench head shown in FIG. 1. Referring now to FIGS. 1, 2, 3 and 4 together, open-end wrench head 1 has two jaws 3 and 5. Each jaw has an outer part, wherein jaw 3 has outer part 7; and, jaw 5 has outer part 9. Outer part 7 of jaw 3 is best seen in FIG. 2; and, outer part 9 of jaw 5 is best seen in FIG. 3. Note that the outer part 7 of jaw 3, and, outer part 9 of jaw 5 are each substantially smooth which is typical of prior art open-end wrench heads. Each of the jaws of this prior-art open-end wrench head is susceptible to bending and spreading apart from the other jaw when the wrench head is put under torque stress. This is especially relevant during an engagement failure wherein the wrench head slips around a work-piece which can cause injury to a user and/or permanent damage to the wrench head wherein the tips of the jaws become permanently spread apart.

Figure 5:
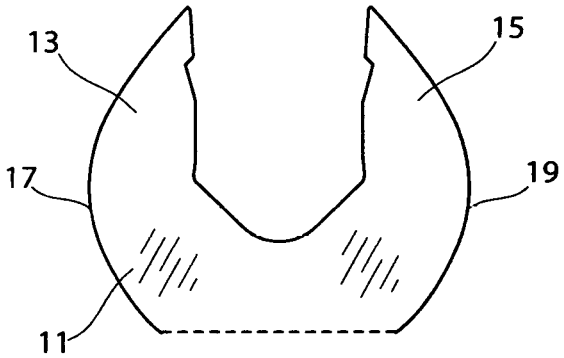
FIG. 5 prior art
FIG. 5 shows a cut, top view of another prior art open-end wrench head.
Figure 6:
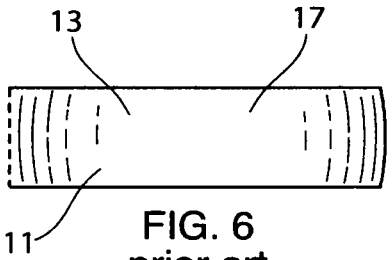
FIG. 6 prior art
FIG. 6 shows a left side elevation view of the wrench head shown in FIG. 5.
Figure 8:
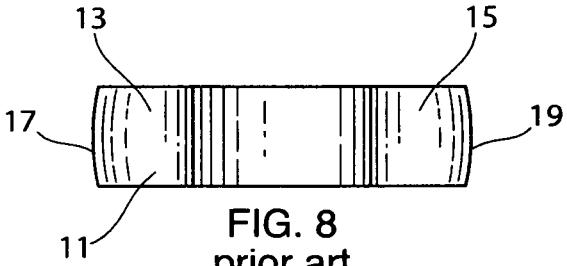
FIG. 8 prior art
FIG. 8 shows a front elevation view of the wrench head shown in FIG. 5.
Figure 7:
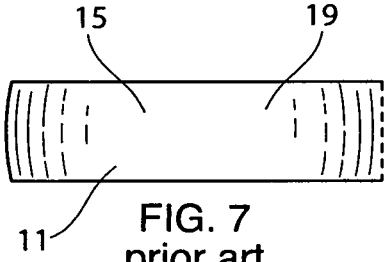
FIG. 7 prior art
FIG. 7 shows a right-side elevation view of the wrench head shown in 5.

FIG. 5 shows a cut, top view of another prior-art open-end wrench head; and, FIG. 6 shows a left side elevation view of the wrench head shown in FIG. 5; and, FIG. 7 shows a right-side elevation view of the wrench head shown in FIG. 5; and, FIG. 8 shows a front elevation view of the wrench head shown in FIG. 5. Referring now to FIGS. 5, 6, 7 and 8 together, open-end wrench head 11 has two jaws 13 and 15. Each jaw has an outer part, wherein jaw 13 has outer part 17; and, jaw 15 has outer part 19. Outer part 17 of jaw 13 is best seen in FIG. 6; and, outer part 19 of jaw 15 is best seen in FIG. 7. Note that the outer part 17 of jaw 13, and, outer part 19 of jaw 15 are each substantially smooth which is typical of prior art open-end wrench heads. Each of the jaws of this prior-art open-end wrench head is susceptible to bending and spreading apart from the other jaw when the wrench head is put under torque stress. This is especially relevant during an engagement failure wherein the wrench head slips around a work-piece which can cause injury to a user and/or permanent damage to the wrench head wherein the tips of the jaws become permanently spread apart.

Figure 9:
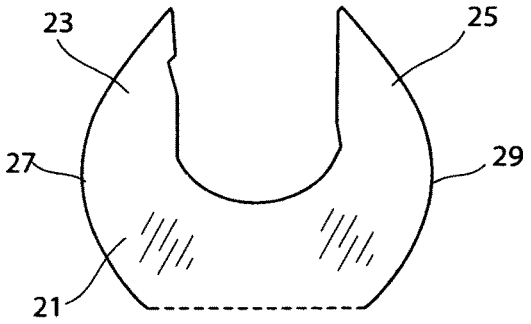
FIG. 9 prior art
FIG. 9 shows a cut, top view of another prior art open-end wrench head.
Figure 10:
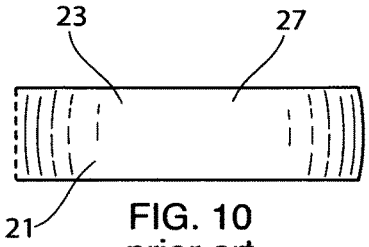
FIG. 10 prior art
FIG. 10 shows a left side elevation view of the wrench head shown in FIG. 9.
Figure 12:
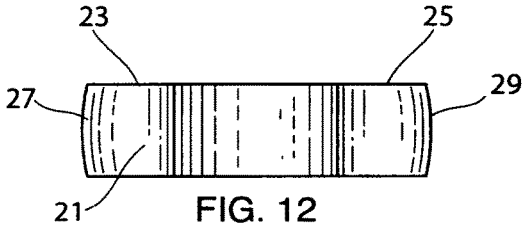
FIG. 12 prior art
FIG. 12 shows a front elevation view of the wrench head shown in FIG. 9.
Figure 11:
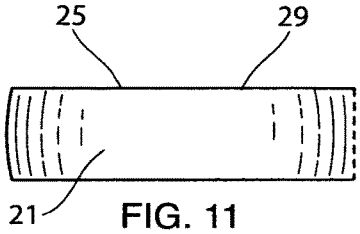
FIG. 11 prior art
FIG. 11 shows a right-side elevation view of the wrench head shown in FIG. 9.

FIG. 9 shows a cut, top view of another prior-art open-end wrench head; and, FIG. 10 shows a left side elevation view of the wrench head shown in FIG. 9; and, FIG. 11 shows a right-side elevation view of the wrench head shown in FIG. 9; and, FIG. 12 shows a front elevation view of the wrench head shown in FIG. 9. Referring now to FIGS. 9, 10, 11 and 12 together, open-end wrench head 21 has two jaws 23 and 25. Each jaw has an outer part, wherein jaw 23 has outer part 27; and, jaw 25 has outer part 29. Outer part 27 of jaw 23 is best seen in FIG. 10; and, outer part 29 of jaw 25 is best seen in FIG. 11. Note that the outer part 27 of jaw 23, and, outer part 29 of jaw 25 are each substantially smooth which is typical of prior art open-end wrench heads. Each of the jaws of this prior-art open-end wrench head is susceptible to bending and spreading apart from the other jaw when the wrench head is put under torque stress. This is especially relevant during an engagement failure wherein the wrench head slips around a work-piece which can cause injury to a user and/or permanent damage to the wrench head wherein the tips of the jaws become permanently spread apart.

Figure 13:
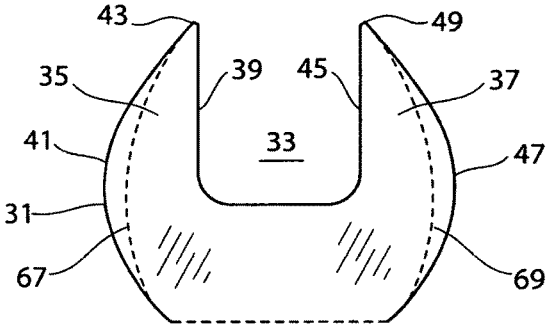
FIG. 13 shows a cut, top view of a present invention open-end wrench head with a top view similar to the wrench head shown in FIG. 1.
Figure 14:
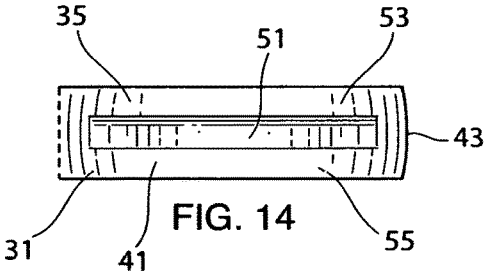
FIG. 14 shows a left side elevation view of the present invention wrench head shown in FIG. 13.
Figure 16:
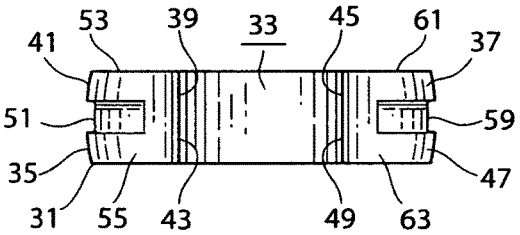
FIG. 16 shows a front elevation view of the present invention wrench head shown in FIG. 13.
Figure 15:
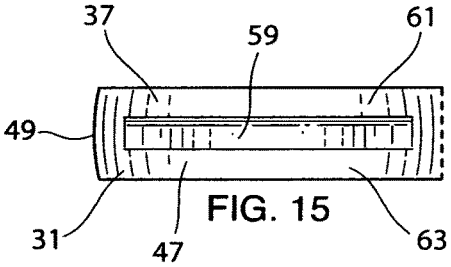
FIG. 15 shows a right-side elevation view of the present invention wrench head shown in FIG. 13.
Figure 21:
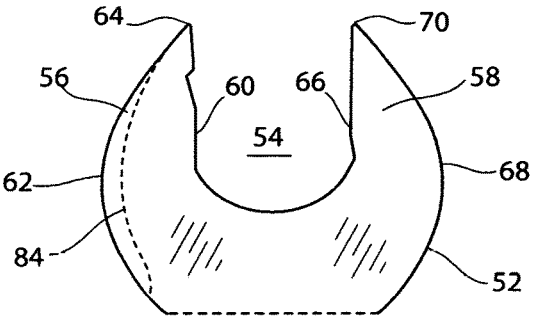
FIG. 21 shows a cut, top elevation view of a present invention open-end wrench head similar to the wrench head shown in FIG. 9.

FIG. 13 shows a cut, top view of a present invention open-end wrench head; and, FIG. 14 shows a left side elevation view of the wrench head shown in FIG. 13; and, FIG. 15 shows a right-side elevation view of the wrench head shown in FIG. 13; and, FIG. 16 shows a front elevation view of the wrench head shown in FIG. 13. Referring now to FIGS. 13, 14, 15 and 16 together, open-end wrench head 31 has an orifice 33 and two jaws 35 and 37. Each jaw has an inner part, an outer part, and a terminal tip end. Accordingly, jaw 35 has inner part 39, outer part 41 and terminal tip end 43; and, jaw 37 has inner part 45, outer part 47 and terminal tip end 49. Each of jaw inner parts 39 and 45 is formed for contact and engagement with a work-piece such as a nut or bolt. These inner parts may be symmetrical to each other as they are in this embodiment; or, non-symmetrical to each other as shown in FIG. 21. Jaw outer part 41 of jaw 35 is viewable from a side view of the wrench head 31 as shown in FIG. 14; and, jaw outer part 47 of jaw 37 is viewable from a side view of wrench head 31 as shown in FIG. 15. Each outer part 41 and 47 of jaws 35 and 37 respectively, has a predetermined length as shown in FIGS. 14 and 15. In all embodiments of the present invention, the outer part of at least one jaw has at least one groove formed therein creating at least two adjacent ridges running at least partially along the length thereof. In this embodiment of the present invention, each of the two jaws has one groove and two adjacent ridges, whereas, jaw outer part 41 of jaw 35 has groove 51 and adjacent ridges 53 and 55; and, outer part 47 of jaw 37 has groove 59 and adjacent ridges 61 and 63 as shown. The groove(s) and ridges enhance jaw structural strength to diminish jaw flexing and bending to reduce the potential of engagement failures, user injury, and permanent jaw tip spread.

Preferred embodiments of the present invention have one or two grooves in one or both jaws. However, the present invention may have as few as one groove and two adjacent ridges on just one jaw of a wrench head, or multiple grooves and multiple ridges on one or both jaws of a wrench head. It's preferable that the groove(s) and ridges are formed via a forging process. In this embodiment of the present invention the grooves and ridges are formed via a forging process to further enhance the structural strength of each jaw to further diminish jaw flexing and bending to reduce the potential of engagement failures, user injury, and permanent jaw tip spread. Forging the innovative groove(s) and ridges is preferred but not a requirement. Also, grooves 51 and 59 do not extend to the terminal tip end of each jaw, whereas, groove 51 does not extend fully to the tip end 43 of jaw 35; and, groove 59 does not extend to the tip end 49 of jaw 37 as shown. Accordingly, it is preferred that each groove does not extend fully to the tip end of a jaw, however, this is not a requirement.

The depth of groove 51 into jaw 35 is depicted by dotted line 67; and, the depth of groove 59 into jaw 37 is depicted by dotted line 69 shown in FIG. 13. It's preferable that each groove is not too deep or deep enough to penetrate the jaw which could reduce the intended additional jaw strength and affect the inner jaw part(s) intended for engagement with a work-piece.

This embodiment of the present invention has a "one piece" wrench head" although this is not a requirement. Accordingly, the present invention open-end wrench head may have multiple parts such as an adjustable open-end wrench head which has a fixed jaw and a movable jaw.

Figure 17:
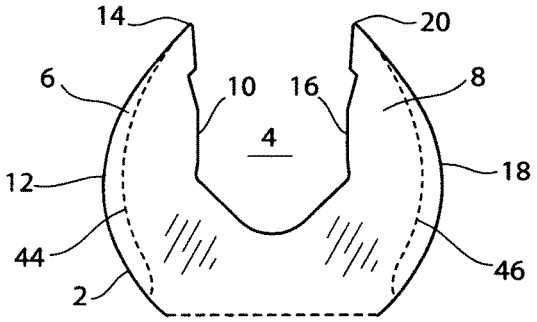
FIG. 17 shows a cut, top view of a present invention open-end wrench head with a top view similar to the wrench head shown in FIG. 5.
Figure 18:
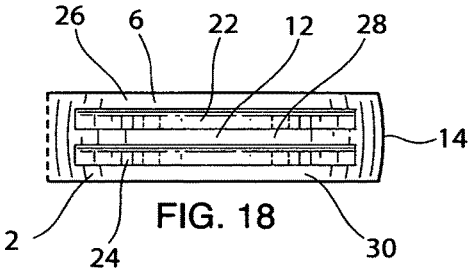
FIG. 18 shows a left side elevation view of the present invention wrench head shown in FIG. 17.
Figure 20:
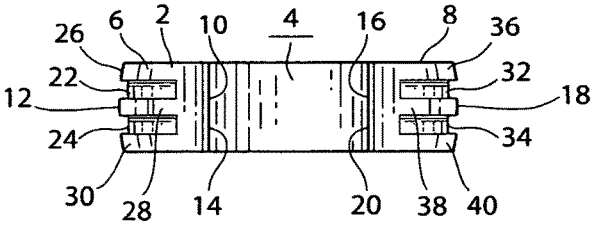
FIG. 20 shows a front elevation view of the present invention wrench head shown in FIG. 17.
Figure 19:
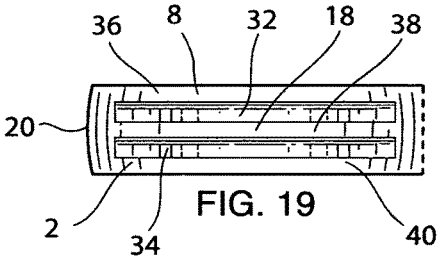
FIG. 19 shows a right-side elevation view of the present invention wrench head shown in FIG. 17.

FIG. 17 shows a cut, top view of a present invention open-end wrench head; and, FIG. 18 shows a left side elevation view of the wrench head shown in FIG. 17; and, FIG. 19 shows a right-side elevation view of the wrench head shown in FIG. 17; and, FIG. 20 shows a front elevation view of the wrench head shown in FIG. 17. Referring to FIGS. 17, 18, 19 and 20 together, open-end wrench head 2 has an orifice 4 and two jaws 6 and 8. Each jaw has an inner part, an outer part, and a terminal tip end. Accordingly, jaw 6 has inner part 10, outer part 12 and terminal tip end 14; and, jaw 8 has inner part 16, outer part 18 and terminal tip end 20. Each of jaw inner parts 10 and 16 is formed for contact and engagement with a work-piece such as a nut or bolt. These inner parts may be symmetrical to each other as they are in this embodiment; or, non-symmetrical to each other as shown in FIG. 21. Jaw outer part 12 of jaw 6 is viewable from a side view of the wrench head 2 as shown in FIG. 18; and, jaw outer part 18 of jaw 8 is viewable from a side view of wrench head 2 as shown in FIG. 19. Each outer part 12 and 18 of jaws 6 and 8 respectively, has a predetermined length as shown in FIGS. 18 and 19. In all embodiments of the present invention, the outer part of at least one jaw has at least one groove formed therein creating at least two adjacent ridges running at least partially along the length thereof. In this embodiment of the present invention, each of the two jaws has two grooves creating three ridges, whereas, jaw outer part 12 of jaw 6 has grooves 22 and 24; and ridges 26, 28, and 30 as shown. And, jaw outer part 18 of jaw 8 has grooves 32 and 34; and ridges 36, 38, and 40 as shown.

The groove(s) and ridges enhance jaw structural strength to diminish jaw flexing and bending to reduce the potential of engagement failures, user injury, and permanent jaw tip spread. Preferred embodiments of the present invention have one or two grooves in one or both jaws. However, the present invention may have as few as one groove and two adjacent ridges on just one jaw of a wrench head, or multiple grooves and multiple ridges on one or both jaws of a wrench head. This embodiment of the present invention comprises 2 grooves and three ridges on each outer jaw.

It's preferable that the groove(s) and ridges are formed via a forging process. In this embodiment of the present invention the grooves and ridges are formed via a forging process to further enhance the structural strength of each jaw to further diminish jaw flexing and bending to reduce the potential of engagement failures, user injury, and permanent jaw tip spread. Forging the innovative groove(s) and ridges is preferred but not a requirement. Also, each of grooves 22, 24, 32, and 34 do not extend to the terminal tip end of each jaw, whereas, grooves 22 and 24 do not extend fully to the tip end 14 of jaw 6; and, grooves 32 and 34 do not extend to the tip end 20 of jaw 8 as shown. Accordingly, it is preferred that each groove does not extend fully to the tip end of a jaw, however, this is not a requirement.

The depth of grooves 22 and 24 are the same and depicted by dotted line 44; and, the depth of grooves 32 and 34 are the same and depicted by dotted line 46 as shown in FIG. 17. The depths of multiple grooves may vary from one another or be the same. It's preferable that each groove is not too deep or deep enough to penetrate the jaw which could reduce the intended additional jaw strength and affect the inner jaw part(s) intended for engagement with a work-piece.

This embodiment of the present invention has a "one piece" wrench head" although this is not a requirement. Accordingly, the present invention open-end wrench head may have multiple parts such as an adjustable open-end wrench head which has a fixed jaw and a movable jaw.

Figure 22:
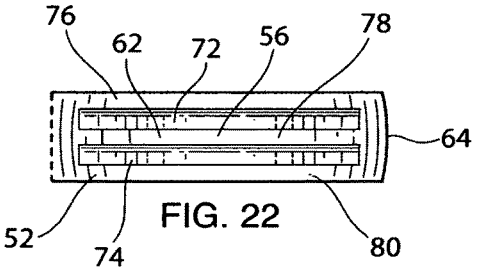
FIG. 22 shows a left side elevation view of the present invention wrench head shown in FIG. 21.
Figure 24:
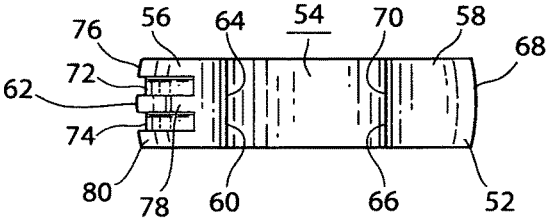
FIG. 24 shows a front elevation view of the present invention wrench head shown in FIG. 21.
Figure 23:
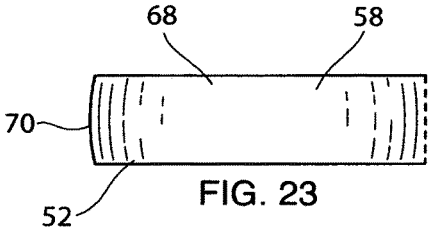
FIG. 23 shows a right-side elevation view of the present invention wrench head shown in FIG. 21.

FIG. 21 shows a cut, top view of a present invention open-end wrench head; and, FIG. 22 shows a left side elevation view of the wrench head shown in FIG. 21; and, FIG. 23 shows a right-side elevation view of the wrench head shown in FIG. 21; and, FIG. 24 shows a front elevation view of the wrench head shown in FIG. 21. Referring to FIGS. 21, 22, 23 and 24 together, open-end wrench head 52 has an orifice 54 and two jaws 56 and 58. Each jaw has an inner part, an outer part, and a terminal tip end. Accordingly, jaw 56 has inner part 60, outer part 62 and terminal tip end 64; and, jaw 58 has inner part 66, outer part 68 and terminal tip end 70. Each of jaw inner parts 60 and 66 is formed for contact and engagement with a work-piece such as a nut or bolt. These inner parts may be symmetrical to each other; or, non-symmetrical to each other as they are in this embodiment seen in FIG. 21. Jaw outer part 62 of jaw 56 is viewable from a side view of the wrench head 52 as shown in FIG. 22; and, jaw outer part 68 of jaw 58 is viewable from a side view of wrench head 52 as shown in FIG. 23. Each outer part 62 and 68 of jaws 56 and 58 respectively, has a predetermined length as shown in FIGS. 22 and 23. In all embodiments of the present invention, the outer part of at least one jaw has at least one groove formed therein creating at least two adjacent ridges running at least partially along the length thereof. In this embodiment of the present invention, outer part 62 of jaw 58 has two grooves creating three ridges; and, outer part 68 of jaw 58 is substantially smooth with no grooves or ridges. Outer part 62 of jaw 56 has grooves 72 and 74; and ridges 76, 78, and 80 as shown.

The groove(s) and ridges enhance jaw structural strength to diminish jaw flexing and bending to reduce the potential of engagement failures, user injury, and permanent jaw tip spread. Preferred embodiments of the present invention have one or two grooves in one or both jaws. However, the present invention may have as few as one groove and two adjacent ridges on just one jaw of a wrench head, or multiple grooves and multiple ridges on one or both jaws of a wrench head. This embodiment of the present invention comprises 2 grooves and three ridges on just one jaw. This is because, the inner parts 60 and 66 of jaws 56 and 58 respectively are non-symmetrical to each other, and the wrench is designed to be turned in a predetermined direction. Accordingly, only one jaw (jaw 56) requires additional strengthening more than the other jaw (jaw 58).

It's preferable that the groove(s) and ridges are formed via a forging process. In this embodiment of the present invention the grooves and ridges are formed via a forging process to further enhance the structural strength of jaw 56 to further diminish jaw flexing and bending to reduce the potential of engagement failures, user injury, and permanent jaw tip spread. Forging the innovative groove(s) and ridges is preferred but not a requirement. Also, each of grooves 72 and 74 do not extend to the terminal tip of the jaw, whereas, grooves 72 and 74 do not extend fully to the tip end 64 of jaw 56. It's preferred that each groove does not extend fully to the tip end of a jaw, however, this is not a requirement.

The depth of grooves 72 and 74 are the same and depicted by dotted line 84. The depths of multiple grooves may vary from one another or be the same. It's preferable that each groove is not too deep or deep enough to penetrate the jaw which could reduce the intended additional jaw strength and affect the inner jaw part(s) intended for engagement with a work-piece.

This embodiment of the present invention has a "one piece" wrench head" although this is not a requirement. Accordingly, the present invention open-end wrench head may have multiple parts such as an adjustable open-end wrench head which has a fixed jaw and a movable jaw.

Figure 25:
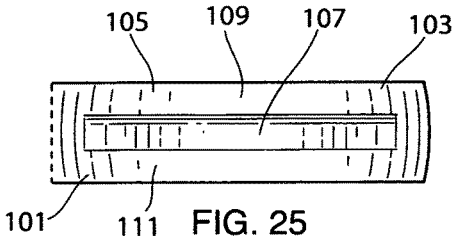
FIG. 25 shows a left side elevation view of another present invention wrench head.
Figure 26:
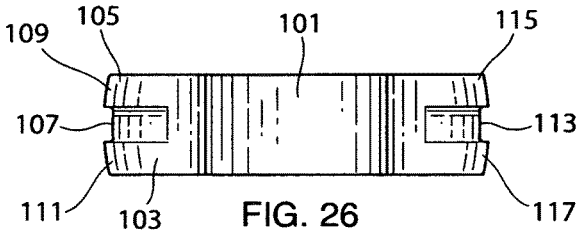
FIG. 26 shows a front elevation view of the present invention wrench head shown in FIG. 25.

FIG. 25 shows a left side elevation view of another present invention wrench head; and, FIG. 26 shows a front elevation view of the present invention wrench shown in FIG. 25. Referring to FIGS. 25 and 26 together, wrench head 101 has a left side jaw 103 with an outer part 105 that has one groove 107 and two adjacent ridges 109 and 111. And, the right-side jaw seen partially in FIG. 26 has the same structure as the left side jaw with one groove 113 and two adjacent ridges 115 and 117. The groove(s) and ridges enhance jaw structural strength to diminish jaw flexing and bending to reduce the potential of engagement failures, user injury, and permanent jaw tip spread.

Figure 27:
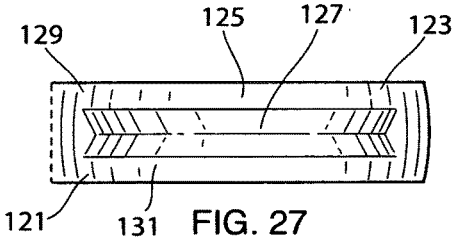
FIG. 27 shows a left side elevation view of another present invention wrench head.
Figure 28:
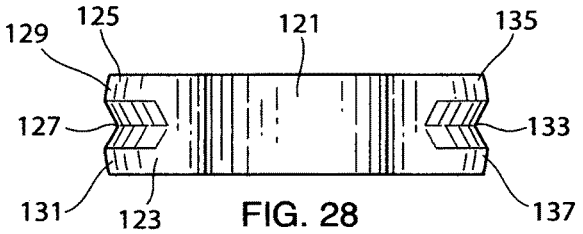
FIG. 28 shows a front elevation view of the present invention wrench head shown in FIG. 27.

FIG. 27 shows a left side elevation view of another present invention wrench head; and FIG. 28 shows a front elevation view of the present invention wrench shown in FIG. 27. Referring to FIGS. 27 and 28 together, wrench head 121 has a left side jaw 123 with an outer part 125 that has one "V" shaped groove 127 and two adjacent ridges 129 and 131. And, the right-side jaw seen partially in FIG. 28 has the same structure as the left side jaw with one "V" shaped groove 133 and two adjacent ridges 135 and 137. The groove(s) and ridges enhance jaw structural strength to diminish jaw flexing and bending to reduce the potential of engagement failures, user injury, and permanent jaw tip spread.

Figure 29:
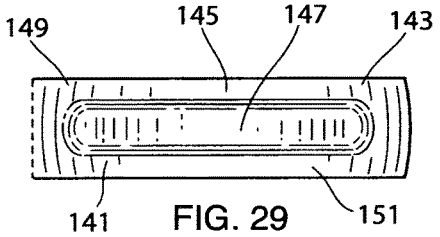
FIG. 29 shows a left side elevation view of another present invention wrench head.
Figure 30:
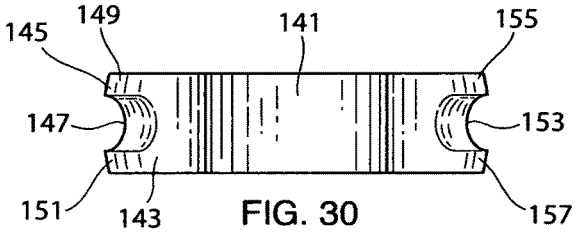
FIG. 30 shows a front elevation view of the present invention wrench head shown in FIG. 29.

FIG. 29 shows a left side elevation view of another present invention wrench head; and, FIG. 30 shows a front elevation view of the present invention wrench shown in FIG. 29. Referring to FIGS. 29 and 30 together, wrench head 141 has a left side jaw 143 with an outer part 145 that has one "U" shaped groove 147 and two adjacent ridges 149 and 151. And, the right-side jaw seen partially in FIG. 30 has the same structure as the left side jaw with one "U" shaped groove 153 and two adjacent ridges 155 and 157. The groove(s) and ridges enhance jaw structural strength to diminish jaw flexing and bending to reduce the potential of engagement failures, user injury, and permanent jaw tip spread.

Figure 31:
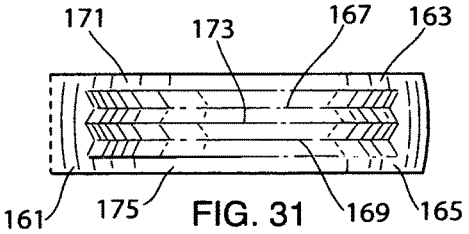
FIG. 31 shows a left side elevation view of another present invention wrench head.
Figure 32:
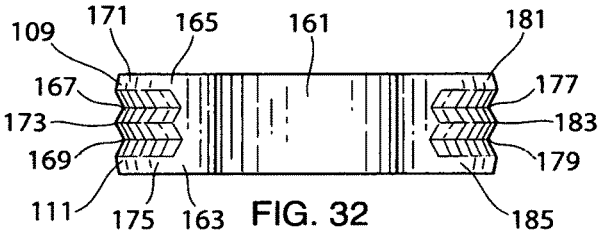
FIG. 32 shows a front elevation view of the present invention wrench head shown in FIG. 31.

FIG. 31 shows a left side elevation view of another present invention wrench head; and, FIG. 32 shows a front elevation view of the present invention wrench shown in FIG. 31. Referring to FIGS. 31 and 32 together, wrench head 161 has a left side jaw 163 with an outer part 165 that has two "V" shaped grooves 167 and 169: and, three formed ridges 171, 173, and 175. And, the right-side jaw seen partially in FIG. 32 has the same structure as the left side jaw with two "V" shaped grooves 177 and 179 and three formed ridges 181, 183 and 185. The grooves and ridges enhance jaw structural strength to diminish jaw flexing and bending to reduce the potential of engagement failures, user injury, and permanent jaw tip spread.

Figure 33:
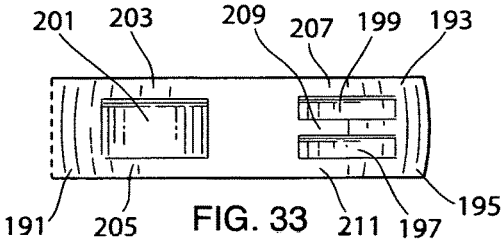
FIG. 33 shows a front elevation view of another present invention wrench head.
Figure 34:
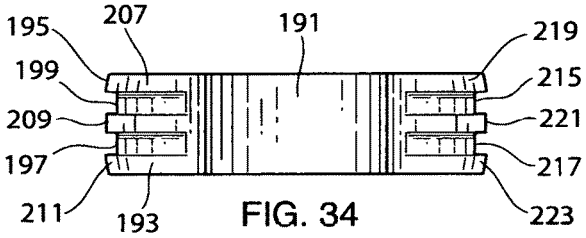
FIG. 34 shows a front elevation view of the present invention wrench head shown in FIG. 33.

FIG. 33 shows a left side elevation view of another present invention wrench head; and, FIG. 34 shows a front elevation view of the present invention wrench shown in FIG. 33. Referring to FIGS. 33 and 34 together, wrench head 191 has a left side jaw 193 with an outer part 195 that has three grooves 197, 199 and 201; and five formed ridges 203, 205, 207, 209 and 211. And, the right-side jaw seen partially in FIG. 34 has the same structure as the left side jaw with 2 grooves visible 215 and 217; and, three ridges visible 219, 221 and 223. The grooves and ridges enhance jaw structural strength to diminish jaw flexing and bending to reduce the potential of engagement failures, user injury, and permanent jaw tip spread.

Upon reading and understanding the specification of the present invention described above, modifications and alterations will become apparent to those skilled in the art. It is intended that all such modifications and alterations be included insofar as they come within the scope of the patent as claimed or the equivalence thereof.

Having thus described the invention, the following is claimed:

1. An open-end wrench head comprising an orifice and two jaws, each said jaw having an inner part, an outer part, and a terminal tip end;

each said inner part being formed for contact and engagement with a work-piece such as a nut or bolt;

each said outer part being viewable from a side view of said wrench head and having a predetermined length; the outer part of at least one jaw having at least one groove formed therein creating at least two adjacent ridges running at least partially along the length thereof.

2. The open-end wrench of claim 1, wherein the at least one groove and at least two ridges of said at least one jaw are formed via a forging process.

3. The open-end wrench of claim 2, wherein the at least one groove of said at least one jaw does not extend to the terminal tip end thereof.

4. The open-end wrench of claim 2, wherein the at least one groove of said at least one jaw is formed so as not to fully penetrate said jaw.

5. The open-end wrench of claim 1, wherein the at least one groove of said at least one jaw does not extend to the terminal tip end thereof.

6. The open-end wrench of claim 1, wherein the at least one groove of said at least one jaw is formed so as not to fully penetrate said jaw.

7. The open-end wrench of claim 1, wherein said wrench head is a one-piece wrench head.

8. The open-end wrench of claim 1, wherein the outer part of said least one jaw has one groove and two ridges.

9. The open-end wrench of claim 1, wherein the outer part of said least one jaw has two grooves and three ridges.

10. The open-end wrench of claim 1, wherein the outer part of only one jaw has at least one groove formed therein creating at least two adjacent ridges running at least partially along the length thereof.

11. The open-end wrench of claim 1, wherein the inner part of one jaw is formed non-symmetrical to the inner part of the other said jaw.

12. The open-end wrench of claim 1, wherein the inner part of one jaw is formed substantially symmetrical to the inner part of the other said jaw.

13. An open-end wrench head comprising an orifice and two jaws, each said jaw having an inner part, an outer part, and a terminal tip end;

each said inner part being formed for contact and engagement with a work-piece such as a nut or bolt;

each said outer part being viewable from a side view of said wrench head and having a predetermined length; the outer part of each of said two jaws having at least one groove formed therein creating at least two adjacent ridges running at least partially along the length thereof; the at least one groove and at least two ridges of each of said two jaws being formed via a forging process; and, further wherein the at least one groove of each of said two jaws being formed not extending to the terminal tip end thereof.

14. The open-end wrench of claim 13, wherein the at least one groove of each of said two jaws is formed so as not to fully penetrate said jaw.

15. The open-end wrench of claim 14, wherein said wrench head is a one-piece wrench head.

16. The open-end wrench of claim 13, wherein said wrench head is a one-piece wrench head.

17. The open-end wrench of claim 13, wherein the outer part of each of said two jaws has one groove and two ridges.

18. The open-end wrench of claim 13, wherein the outer part of each of said two jaws has two grooves and three ridges.

19. The open-end wrench of claim 13, wherein the inner part of one jaw is formed non-symmetrical to the inner part of the other said jaw.

20. The open-end wrench of claim 13, wherein the inner part of one jaw is formed substantially symmetrical to the inner part of the other said jaw.

* * * * *